US007074279B2

(12) United States Patent
Matsumoto et al.

(10) Patent No.: US 7,074,279 B2
(45) Date of Patent: Jul. 11, 2006

(54) METHOD FOR REMOVING TITANIUM BASED COATING FILM OR OXIDE OF TITANIUM

(75) Inventors: Keiji Matsumoto, Nagoya (JP); Susumu Matsuoka, Nagoya (JP); Yuji Asai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 254 days.

(21) Appl. No.: 10/474,436

(22) PCT Filed: Feb. 13, 2003

(86) PCT No.: PCT/JP03/01501

§ 371 (c)(1),
(2), (4) Date: Oct. 9, 2003

(87) PCT Pub. No.: WO03/074764

PCT Pub. Date: Sep. 12, 2003

(65) Prior Publication Data

US 2004/0110654 A1 Jun. 10, 2004

(30) Foreign Application Priority Data

Mar. 1, 2002 (JP) ..... 2002-055452

(51) Int. Cl.
*C23G 1/02* (2006.01)

(52) U.S. Cl. ..... 134/3; 134/41

(58) Field of Classification Search ..... None
See application file for complete search history.

(56) References Cited

U.S. PATENT DOCUMENTS

| | | | | |
|---|---|---|---|---|
| 5,232,619 | A | 8/1993 | Sue | |
| 5,693,550 | A * | 12/1997 | Torii | 438/303 |
| 5,883,003 | A * | 3/1999 | Matsubara | 438/655 |
| 5,976,988 | A * | 11/1999 | Konuma et al. | 438/745 |
| 6,031,290 | A * | 2/2000 | Miyazaki et al. | 257/764 |
| 6,482,570 | B1 * | 11/2002 | Hotta | 430/302 |
| 6,566,257 | B1 * | 5/2003 | Sueyoshi | 438/682 |

FOREIGN PATENT DOCUMENTS

| | | |
|---|---|---|
| JP | A 9-109126 | 4/1997 |
| JP | A 2000-216383 | 8/2000 |

* cited by examiner

*Primary Examiner*—Gregory Webb
(74) *Attorney, Agent, or Firm*—Oliff & Berridge, PLC

(57) ABSTRACT

There are here disclosed a method for removing a titanium-based film from a honeycomb-molding die having on the surface of a base material coated with the titanium-based film, and a method for removing an oxide of titanium from a honeycomb-molding die having the oxide of titanium adhered/deposited on the surface of a base material. In each method, a removing solution comprising a mixture of an acid and hydrogen peroxide is used. According to the methods for removing the titanium-based film and the oxide of titanium, a large amount of the titanium-based film as well as the oxide of titanium adhered/deposited on the base material of a honeycomb-molding die can be removed by use of a small amount of the removing solution without corroding the base material of honeycomb-molding die while re-deposition of dissolved titanium ions on the base material is prevented.

6 Claims, No Drawings

METHOD FOR REMOVING TITANIUM BASED COATING FILM OR OXIDE OF TITANIUM

FIELD OF THE INVENTION

The present invention relates to a method for removing a titanium-based film and an oxide of titanium. More specifically, it relates to a method for removing a titanium-based film and an oxide of titanium from a honeycomb-molding die.

BACKGROUND ART

Heretofore, as a die used for extrusion of a ceramic honeycomb, a honeycomb-molding die is known which has such a structure that groove-like slits are formed on the front surface in cell blocks and body introduction holes communicated with the slits are formed on the rear surface.

In order to adjust the widths of the slits of the cell blocks and improve the durability of the die, such a honeycomb-molding die is produced by, for example, a method of coating a stainless base material with a titanium-based film having excellent abrasion resistance (film containing, as components, one or more materials selected from the group consisting of TiC, TiN and TiCN) by CVD or PVD.

At present, when a honeycomb-molding die having a base material coated with a titanium-based film is worn, regeneration of the honeycomb-molding die is carried out primarily by immersing the honeycomb-molding die in a solution so as to remove the remaining titanium-based film, coating the base material with the titanium-based film again, and then making a pattern adjustment.

In this case, as the above solution, there are generally used (1) a removing solution containing 60 to 70% of nitric acid as a main component (refer to Japanese Patent Application Laid-Open No. 109126/1997), (2) a removing solution containing 35% or lower of hydrogen peroxide as a main component, and (3) a removing solution containing hydrogen fluoride as a main component.

However, all of these removing solutions are intended to be used to remove a relatively small amount of titanium-based film. Thus, they have the following problems in removing a large amount of titanium-based film when a wide surface area is coated with a relatively thick titanium-based film as in the case of the honeycomb-molding die.

Firstly, although the removing solution containing nitric acid as the main component has great power to dissolve titanium, titanium ions in nitric acid are liable to change into an oxide and be deposited. Thus, when the amount of titanium-based film to be dissolved is large as compared with the amount of nitric acid, titanium ions dissolved in nitric acid once are deposited as an oxide.

As a result, when the removing solution containing nitric acid as the main component is used, an oxide of titanium is re-deposited on the surface of a base material, thereby making it impossible in some cases to recoat the base material after removal.

Further, since the oxide of titanium is stable, it cannot be removed by the removing solution containing nitric acid as the main component, once it is deposited on the surface of the base material.

Secondly, although the removing solution containing hydrogen peroxide as the main component has great power to dissolve and retain titanium, it is decomposed into water and oxygen due to the presence of metal ions dissolved from a base material or the like. Thus, titanium ions dissolved once are deposited as the oxide of titanium due to decomposition of hydrogen peroxide.

For this reason, when a titanium-based film is removed by use of hydrogen peroxide, a large amount of the removing solution must be used in consideration of the decomposition of hydrogen peroxide.

Thirdly, since the removing solution containing hydrogen fluoride as the main component is highly caustic, it is inappropriate to use the removing solution for removing a titanium-based film formed on a stainless base material since it corrodes even the base material.

The present invention has been conceived in view of such problems of the prior art. An object of the present invention is to provide a method capable of removing a large amount of titanium-based film as well as the oxide of titanium adhered/deposited on the base material of a honeycomb-molding die by use of a small amount of the removing solution without corroding the base material of a honeycomb-molding die while preventing re-deposition of dissolved titanium ions on the base material.

DISCLOSURE OF THE INVENTION

According to the present invention, there is provided a method for removing a titanium-based film from a honeycomb-molding die having a base material coated with the titanium-based film, characterized by using a removing solution comprising a mixture of an acid and hydrogen peroxide.

In this case, the above titanium-based film is preferably a CVD or PVD film containing, as components, one or more materials selected from the group consisting of TiC, TiN and TiCN.

Further, according to the present invention, there is provided a method for removing an oxide of titanium from a honeycomb-molding die having the oxide of titanium adhered/deposited on the surface of a base material, characterized by using a removing solution comprising a mixture of an acid and hydrogen peroxide.

In this case, the above oxide of titanium is preferably a material and mixture comprising one or more components selected from the group consisting of TiO, $Ti_2O_3$, $TiO_2$, $TiO_2.H_2O(H_2TiO_3)$ and $TiO_2.2H_2O(H_4TiO_4)$.

In the present invention, the above removing solution preferably contains 1 to 7 mol/L of the acid and 1 to 12 mol/L of hydrogen peroxide as the main components. Further, the acid used in the present invention is preferably nitric acid or sulfuric acid.

BEST MODE FOR CARRYING OUT THE INVENTION

As described above, the removing method of the present invention is a method for removing a titanium-based film with which a base material is coated and an oxide of titanium adhered/deposited on the surface of the base material from a honeycomb-molding die by use of a removing solution comprising a mixture of an acid and hydrogen peroxide.

According to the method, hydrogen ions in the acid can not only cause titanium to be eluted in the removing solution as titanium ions but also form complexes with titanium ions eluted by hydrogen peroxide so as to stabilize the titanium ions and thereby prevent them from depositing from the solution as the oxide.

Further, anions (e.g., $NO_3^-$, $SO_4^{2-}$) contained in the acid can form complexes with metal ions eluted in the removing solution which cause self-decomposition of hydrogen peroxide and trap them therein so as to prevent the self-decomposition of hydrogen peroxide.

Thus, the removing method of the present invention has an effect of removing a large amount of titanium-based film and the oxide of titanium adhered/deposited on the base material of a honeycomb-molding die by use of a small amount of the removing solution while preventing re-deposition of dissolved titanium ions on the base material of the honeycomb-molding die.

The removing solution for use in the present invention preferably contains 1 to 7 mol/L of the acid and 1 to 12 mol/L of hydrogen peroxide as the main components.

This is important upon causing the above effect to be exerted without causing the base material of the honeycomb-molding die to corrode.

Further, the acid in the present invention is preferably nitric acid or sulfuric acid.

This is because these acids hardly corrode the base material of the honeycomb-molding die and have an excellent effect of removing the titanium-based film.

Further, in the present invention, the titanium-based film is preferably a CVD or PVD film containing, as components, one or more materials selected from the group consisting of TiC, TiN and TiCN, and the oxide of titanium is preferably a material and mixture comprising one or more components selected from the group consisting of TiO, $Ti_2O_3$, $TiO_2$, $TiO_2.H_2O(H_2TiO_3)$ and $TiO_2.2H_2O(H_4TiO_4)$.

Hereinafter, the present invention will be described in more detail with reference to Examples. However, the present invention shall not be limited to these Examples.

EXAMPLES 1 TO 4 AND COMPARATIVE EXAMPLE

A stainless steel board was formed into a board having a thickness of 30 mm and sides of 220 mm by use of a grinding machine.

Further, on one surface of the board, slits each having a width of 0.15 mm and a depth of 3 mm were grooved in the form of a grid at a pitch of 1.1 mm by wire electric discharge machining, while on the other face of the board, holes each having a diameter of 1 mm and a depth of 15 mm were formed at cross points of the slits at a pitch of 1.5 mm (i.e., skipping every other hole) by ECM machining.

After dies (base materials) obtained by the above method were coated with a TiCN film in accordance with CVD, removals of the TiCN film and an oxide of titanium were carried out without corroding the base material in accordance with the following methods (1) to (5).

(1) By use of 12 L of a removing solution (40° C.) comprising 3.5 mol/L of nitric acid and 5.4 mol/L of hydrogen peroxide, 140 g of the TiCN film formed on the above die could be removed in 72 hours (Example 1).

(2) By use of 6 L of a removing solution (40° C.) comprising 1.4 mol/L of sulfuric acid and 5.5 mol/L of hydrogen peroxide, 65 g of the TiCN film formed on the above die could be removed in 72 hours (Example 2).

(3) By use of 12 L of a removing solution (40° C.) comprising 3.5 mol/L of nitric acid and 5.4 mol/L of hydrogen peroxide, less than 5 g of the oxide of titanium formed on the above die could be removed in 8 hours (Example 3).

(4) By use of 6 L of a removing solution (40° C.) comprising 1.4 mol/L of sulfuric acid and 5.5 mol/L of hydrogen peroxide, less than 5 g of the oxide of titanium formed on the above die could be removed in 8 hours (Example 4).

(5) When 60 to 150 g of the TiCN film formed on the die was immersed in 200 L of a removing solution (47° C.) comprising 14.7 mol/L of nitric acid for 72 hours, 0.2 to 4 g of the oxide of titanium was deposited on the surface of the die (Comparative Example).

INDUSTRIAL APPLICABILITY

The method of the present invention for removing a titanium-based film and an oxide of titanium is capable of removing a large amount of titanium-based film as well as the oxide of titanium adhered/deposited on the base material of a honeycomb-molding die, by use of a small amount of the removing solution without corroding the base material of a honeycomb-molding die while preventing re-deposition of dissolved titanium ions on the base material.

The invention claimed is:

1. A method for removing a titanium-based film from a honeycomb-molding die having a base material coated with the titanium-based film, characterized by using a removing solution comprising a mixture of an acid and hydrogen peroxide, wherein the removing solution contains 1 to 7 mol/L of the acid and 1 to 12 mol/L of hydrogen peroxide as the main components.

2. The method for removing a titanium-based film according to claim 1, wherein the acid is nitric acid or sulfuric acid.

3. The method for removing a titanium-based film according to claim 1, wherein the titanium-based film is a CVD or PVD film containing, as components, one or more materials selected from the group consisting of TiC, TiN and TiCN.

4. A method for removing an oxide of titanium from a honeycomb-molding die having the oxide of titanium adhered/deposited on the surface of a base material, characterized by using a removing solution comprising a mixture of an acid and hydrogen peroxide, wherein the removing solution contains 1 to 7 mol/L of the acid and 1 to 12 mol/L of hydrogen peroxide as main components.

5. The method for removing an oxide of titanium according to claim 4, wherein the acid is nitric acid or sulfuric acid.

6. The method for removing an oxide of titanium according to claim 4, wherein the oxide of titanium is a material and mixture comprising one or more components selected from the group consisting of TiO, $Ti_2O_3$, $TiO_2$, $TiO_2.H_2O$ $(H_2TiO_3)$ and $TiO_2.2H_2O(H_4TiO_4)$.

* * * * *